United States Patent [19]

Jones

[11] 3,933,316

[45] Jan. 20, 1976

[54] MILL FOR COMMINUTING ORE MATERIAL

[75] Inventor: Roy D. Jones, Lovelock, Nev.

[73] Assignee: Resource Products, Inc., Berkeley, Calif.

[22] Filed: Mar. 21, 1974

[21] Appl. No.: 453,212

[52] U.S. Cl. ..... 241/170; 241/175; 241/201

[51] Int. Cl.[2] ..... B02C 4/00

[58] Field of Search ..... 241/170, 171, 175, 179, 241/201, 203–206, 221, 226, 228, 229

[56] References Cited

UNITED STATES PATENTS

| | | | |
|---|---|---|---|
| 378,450 | 2/1888 | Kendall | 241/170 X |
| 909,562 | 1/1909 | Donald | 241/170 |
| 2,192,549 | 3/1940 | Hadsel | 241/170 X |
| 3,184,171 | 5/1965 | Daman | 241/171 X |

*Primary Examiner*—Roy Lake
*Assistant Examiner*—E. F. Desmond
*Attorney, Agent, or Firm*—Flehr, Hohbach, Test, Albritton, & Herbert

[57] ABSTRACT

A mill for crushing or comminuting material such as mineral ores. The mill includes a cradle mounted on fulcrum pins carried by a support frame. An upwardly concave arcuate wall of the cradle carries a relatively large diameter roll member having a hollow interior in which a second smaller diameter hollow roll member is carried. Slots are formed in the first roll member to comminuciate material into and from the interior thereof, and a slot may also be formed in the second roll member to communicate material into and from its interior. The lower portion of the cradle is supported in offset relationship from the fulcrum pins by means of compressions springs mounted on the frame. An eccentric drive motor coupled through a connecting rod with the cradle operates to oscillate the cradle in resonance about the fulcrum pins whereby the roll members are moved in a manner to comminute material fed through an inlet zone into the cradle, and to expel the material through a vertical screen disposed across a discharge zone at a side of the cradle. The amplitude of stroke of the connecting rod is effective to momentarily lift the roll members on each stroke in a manner causing the roll members to rotate or gyrate relative to the cradle whereby oversize material is recycled by the slots for subsequent comminution.

19 Claims, 7 Drawing Figures

MILL FOR COMMINUTING ORE MATERIAL

BACKGROUND OF THE INVENTION

This invention relates in general to material crushing and comminuting equipment, and in particular relates to equipment for crushing and comminuting materials such as mineral ores from a quarry or mine.

Various types of crushing and pulverizing equipment have heretofore been used for comminuting minerals ores and other similar hard, rock-like material. Raw material from a quarry or mine is typically reduced in a multi-stage operation which includes a primary stage for coarse reduction, one or more secondary stages for intermediate size reduction, and a third or pulverizing stage for fine size reduction. In the primary stage conventional equipment which has been employed includes jaw crushers, gyratory crushers and cone crushers. Secondary stage crushing equipment conventionally includes hammer mills, jaw, gyratory or cone crushers, and roll type crushers. The pulverizing stage equipment commonly includes ball and tube mills, rod mills, hammer mills and roller pulverizers and the like.

Conventional ball and tube mills and rod mills employ rotating shells containing a plurality of tumbling steel balls or rods which reduce the contained material by impact and attrition. In conventional mills of this type the start-up power requirements are substantially larger than the running power requirements, thus necessitating a drive motor of relatively large horsepower rating to achieve start-up. In such mills it is also necessary to start and stop the mill following set procedures so that there is a minimum load of product material when either starting or stopping. In addition, wear of the elements on mills of this type is a problem with the result that relatively frequent maintenance and downtime is required. Furthermore, over-grinding and ore sliming are problems encountered with conventional pulverizing stage equipment.

OBJECTS AND SUMMARY OF THE INVENTION

It is a general object of the invention to provide a new and improved mill for crushing or comminuting material such as mineral ores.

Another object is to provide a mill of the type described which will find application in a crushing or pulverizing operation as an improved replacement for conventional equipment in many applications.

Another object is to provide a mill of the type described which requires less power for processing the material, which involves less wear of the mill elements, which more efficiently crushes the ore material, which operates with a non-critical water-to-ore density, which reduces over-grinding and sliming, and which is relatively more simple in construction, operation and maintenance.

Another object is to provide a mill of the type described which employs cylindrical roll members carried within a cradle which is mounted in offset relationship on a support frame and pivotally actuated in a manner to lift the roll members on each stroke for imparting relative rotation or gyration of the roll members with respect to the cradle for comminuting the material and for simultaneously recycling oversize material.

The invention is characterized in providing a mill having a cradle mounted on a support frame for back-and-forth pivotal movement about a pair of fulcrums. The cradle includes an upwardly concave arcuate wall which supports a relatively large diameter roll member formed with a hollow interior. A smaller diameter roll member also having a hollow interior is mounted within the interior of the first member. Compression springs are provided to yieldably urge the cradle to a position at which the effective center of gravity of the cradle and roll members is offset horizontally from the fulcrums. Eccentric drive means is provided to impart a recurrent thrust force to a lower portion of the cradle thereby causing the roll members to be momentarily lifted within the cradle on each stroke and undergo a rotation or gyration relative to the cradle. Infeed material such as coarse crushed ore mixed with water is fed into one side of the mill so that the gyrating action of the members comminutes the ores. Elongate slots are formed in the large diameter roll member to permit oversized material to be fed into and from the interior of this roll member for recycling and subsequent comminuting. The small diameter roll member may also be formed with a hollow interior and an elongate slot for recycling of material contained within the interior of the large diameter member. The comminuted material is discharged through a vertical screen or baffle at a side edge of the cradle, and the screen is mounted for movement with the cradle for self-cleaning action.

Additional objects and features of the invention will appear from the following description in which the preferred embodiments have been set forth in detail in conjunction with the accompanying drawings.

DESCRIPTION OF THE PREFERRED EMBODIMENTS

Figure 1:
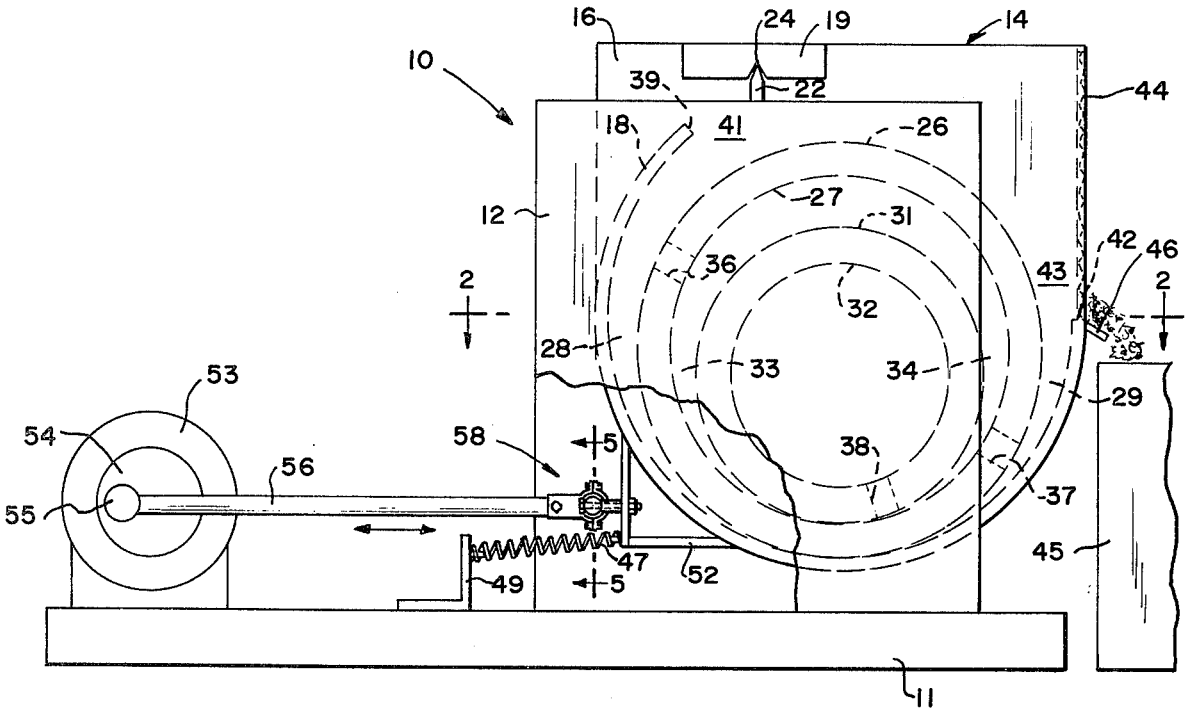
FIG. 1 is a side elevational view of a mill constructed in accordance with the present invention.

In the drawings FIG. 1 illustrates generally at 10 a mill constructed in accordance with the invention and which is used for crushing or comminuting materials such as mineral ores from a quarry or mining operation. It is understood that the invention has application in comminuting a wide range of such materials including all types of rocks or matrix containing minerals in any form, such as metallics, sulfides of minerals, oxides of minerals, chlorides and telerides, ferrous and nonferrous minerals, base metals and precious metals, and more particularly materials which are commonly termed quartz, prophyry, shales, gneiss, schist, all igneous material, metamorphic and sedimentary ore bearing rocks. In addition to processing raw materials directly from a quarry or mine, the invention will also find application in the reclaiming of mill tailings or the reprocessing of old mine dumps.

Mill 10 of the invention is specially adapted for use in the previously described pulverizing stage of a comminuting operation in which the infeed material is received after being processed through primary and secondary stage crushing equipment. In such a case mill 10 would serve as an improved replacement for other equipment in many applications.

Mill 10 includes a lower base 11 upon which a pair of spaced-apart upstanding plates 12, 13 are mounted. The base may be fixed by means such as bolts to a suitable prepared foundation at the crushing site, or alternatively the mill may be unanchored to permit it to be easily transported between work sites, and also to simplify the setup of the mill at the site without the necessity of providing a prepared foundation, as would be required with a conventional ball mill or other similar crusher. The ability of mill to crush material without being anchored is a result of the novel operating features to be described hereafter.

A material-containing tub or cradle 14 is positioned between the upright plates 12 and 13 of the support frame. The cradle comprises a pair of axially spaced-apart end walls 16, 17 between which an upwardly concave, arcuate wall 18 is mounted by suitable means such as welding. The lower portions of the two end walls 16, 17 are semi-circular to conform with the configuration of arcuate wall 18, while the upper portions of these end walls are squared off. A pair of support stirrups 19, 20 formed with downwardly facing V-shaped notches are welded to the outer surface of the cradle end walls 16, 17. The notches of the stirrups are seated over upwardly projecting wedge-shaped fulcrums or pins 22, 23 which are secured to the upper edges of the two frame plates 12, 13. The cradle 14 is free to pivot through an angle relative to the frame about a support axis 24 which passes through the tips of the two pins.

A relatively large diameter, cylindrical roll member 26 is mounted within arcuate wall 18 with its longitudinal axis extending generally parallel to support axis 24. Roll member 26 is formed with a hollow interior 27, and preferably the roll member comprises a steel pipe with an outer diameter less than the inner diameter of arcuate wall 18 so that wedge-shaped spaces 28, 29 are defined on either side of member 26. A second roll member 31 is mounted within the interior 27 of the outer roll member and is oriented with its longitudinal axis also parallel with support axis 24. The second roll member is also formed with a hollow interior 32, and preferably comprises a steel pipe. The outer diameter of member 31 is less than the inner diameter of roll member 26 so that wedge-shaped spaces 33, 34 are formed on opposite sides of the second member. In addition, the lengths of the two roll members are substantially equal to the spacing between the two end walls 16, 17 but with sufficient clearance to permit freedom of movement.

Figure 2:
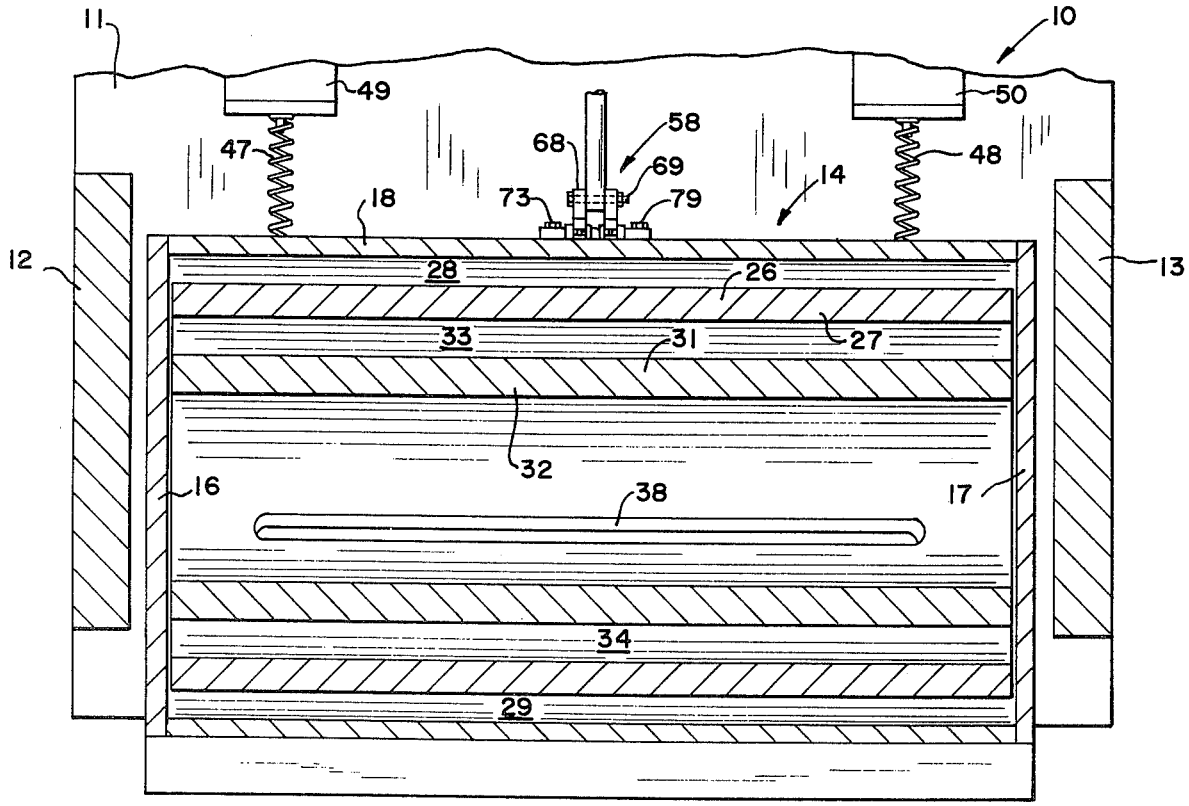
FIG. 2 is a cross-sectional view to an enlarged scale taken along the line 2—2 of FIG. 1.
Figure 3:
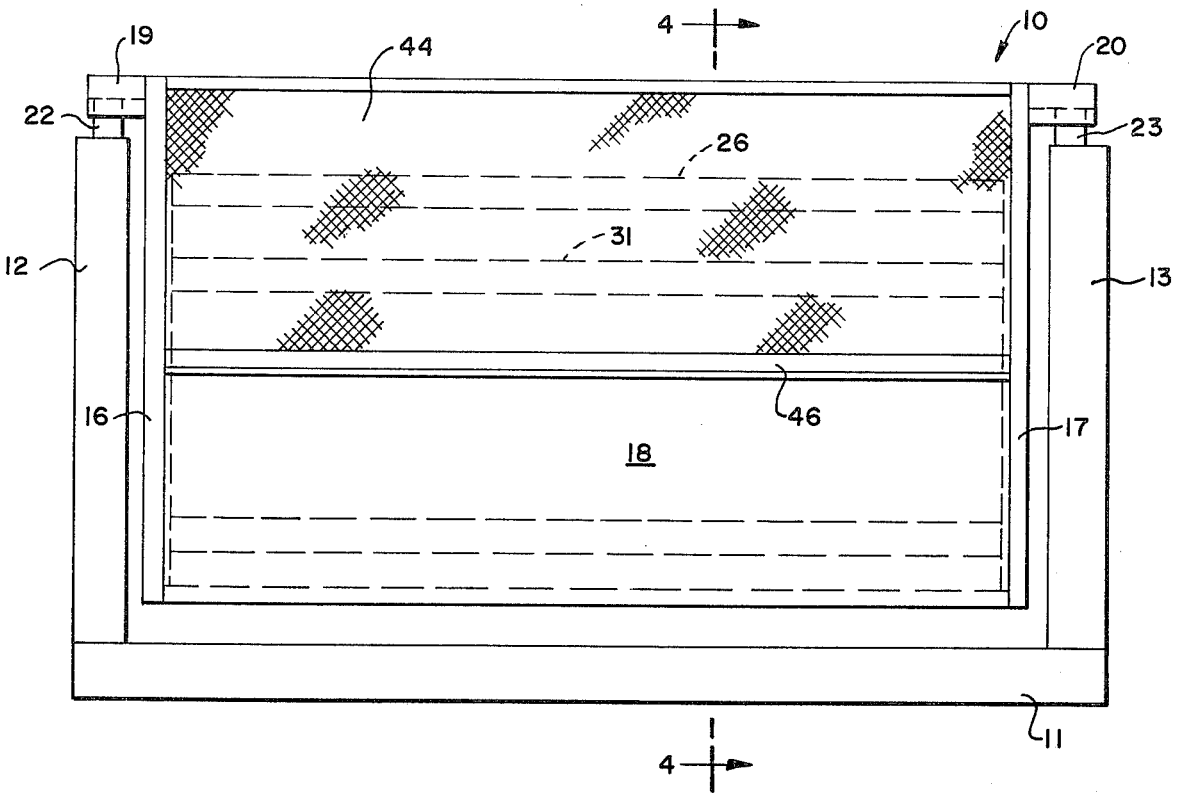
FIG. 3 is an end elevational view of the mill of FIG. 1.

Outer roll member 26 is formed with one or more product recycling openings which are shown as elongate slots 36, 37 of a length less than the length of the member 26. Inner roll member may also be formed with one or more elongate recycling slots 38 of a length less than the length of member 31, as shown in FIG. 2. As required, the number of openings in the roll members could be varied depending upon the size of the component elements of the mill. The recycling slots carry material for recrushing in a manner to be subsequently explained.

A typical mill constructed in accordance with the invention can be sized with arcuate wall 18 of the cradle having an outer diameter of 26 inches and an inner diameter of 24 inches. Outer roll member 26 is formed with an outer diameter of 20 inches and an inner diameter of 16 inches. Inner roll member is formed with an outer diameter of 12 inches and an inner diameter of 6 inches. In this example the roll members are each 4 feet in length. It is understood that the foregoing dimensions are by way of example only, and that the size and configuration of the mill elements may be varied according to the specifications and requirements for a particular application. Thus, a higher capacity for the mill may be provided either by increasing the diameters of the arcuate wall and roll members, by lengthening roll members, or by combination of the physical specifications.

One side edge 39 of arcuate wall 18 terminates at an elevation above the upper dimension of outer roll member 26 to define an inlet zone 41 into which the infeed material, such as a slurry of water and ore, is deposited by gravity from a suitable conveyor, trough or hopper, not shown. The opposite side edge 42 of the arcuate wall terminates at an elevation below that of edge 39 to define a discharge zone 43 between the end walls of the cradle.

Classifying means is provided in the discharge zone for precluding discharge of material above a given size so that oversize material is recycled for subsequent crushing. In the embodiment of FIGS. 1–4 the classifying means comprises an upstanding wire screen mounted between the cradle end walls above edge 42 of the arcuate wall. The screen is mounted for movement with the cradle for a self-cleaning screening action. Screen size is selected according to the product specification. The flow of discharge material from the mill is controlled by edge 42 which acts as a weir in co-operation with the screen. Material which is classified and flows through the screen over the weir falls downwardly by gravity over discharge chute 46 into a suitable receptable 45 for further processing, although the material could also be discharged directly into a trough or conveyer.

One or more counterbalancing compression springs 47, 48 are provided to urge cradle 14 in a counter clockwise direction, as viewed in FIG. 1, to a position at which the effective center of gravity of the cradle and two roll members is counterbalanced in an offset position on the right of a vertical plane passing through support axis 24. The outboard end of the two springs are mounted by brackets 49, 50 to frame base 11, and the inboard ends are mounted by brackets 52 to a lower protion of the cradle.

Actuating means is provided to impart a recurrent thrust force against the cradle so that it is pivotally moved or oscillated through an angle about support axis 24. The actuating means preferably includes a drive motor 53, such as an electric motor, mounted on frame base 11 for rotatably driving an eccentric or crank 54, which also acts as a flywheel. A connecting rod 56 is pivotally mounted at one end 55 to the eccentric and at its other end to the cradle through a resilient connection assembly 58.

Resilient connection assembly 58 provides a degree of angular movement between the connecting rod and cradle, and at the same time provides sufficient resiliency in the actuating means so that the component elements of the mill move in resonance. Connection assembly 58 comprises a connecting pin 59 which is mounted within a pair of resilient ringss 61, 62 formed of a suitable elastomeric material such as rubber. A pair of split clamps 63, 64 are secured about the respective rings by means of bolts 66, 67, and the two clamps are carried on the thrust end of connecting rod 56 by means of a clevis 68 which is fastened to the rod by a bolt 69. The outwardly projecting ends of connecting pin 59 are formed with bores 71, 72 in which respective bolts 73, 74 are mounted. The threaded ends of the bolts extend forwardly through openings formed in a bracket 76 which in turn is mounted by means such as welding to the outer, lower portion of the cradle's arcuate wall 18. A pair of spacers such as the rubber sleeves 77 are mounted about the bolts to provide clearance between assembly 58 and bracket 76. A pair of nuts 78 are turned down onto the threaded ends of bolts 73 and 74 for holding assembly 58 in place. The clamps 63, 64 and rings 61, 62 are adapted to undergo a small range of pivotal movement about pin 59 as eccentric 54 and rod 56 are actuated, and at the same time the resiliency of the rings permits the actuating means to absorb shock forces so that the mill will operate in resonance.

Eccentric 54 is configured to drive connecting rod through a stroke having an amplitude or length sufficient to oscillate cradle through an angle causing the roll members to move in a gyratory action in resonance with the cradle for crushing and pulverizing material which is fed into the wedged-shaped spaces. The roll members intermittently rotate and gyrate relative to the cradle in a counter-clockwise direction, as viewed in FIG. 1. This action is a result of the two roll members being lifted up through a short distance on the forward or thrust stroke of rod 56. On the return stroke of the rod the roll members are partially in suspension. As they begin to fall downwardly the members subsequently impact on the material as the arcuate wall starts the upward swing on the following forward stroke. In addition, the incoming material which is fed through the left-hand wedge-shaped spaces 28 and 33 tends to move the roll members off center to the right as viewed in FIG. 1 for assisting the lifting and counter-clockwise rotation of the roll members. On the return stroke of the rod the compression springs 47, 48 absorb the energy and shock from return movement of the cradle and roll members to permit the rod and fly wheel of the eccentric 54 to run free so that less power is consumed on this stroke. On the following thrust stroke this energy is released from the springs to assist in moving the cradle through an upward arc. The speed of the eccentric stroke may be varied, preferably within the range of 300 to 500 strokes per minute, depending upon the type of material processed and the desired rate of material crushing. The amplitude or length of stroke of rod 56 is varied depending upon the size and configuration of the mill, and for the example described above in which arcuate wall 18 of the cradle has a 26 inch outer diameter, such amplitude is 7/16 of an inch.

An illustration of the use and operation of the invention will now be described and it is understood that the following description is given by way of example and does not limit the scope of the invention. It will be assumed in the example that mill 10 is used for processing medium-hard quartz ore, using a hardness scale ranging from "very hard" to "medium'hard" to "soft ore". Motor 53 of a ¼ HP size rating is provided with an eccentric and connecting rod having a 7/16 inch stroke and with a maximum speed of 760 r.p.m. Screen 44 is sized with openings of 20 mesh.

Figure 4:
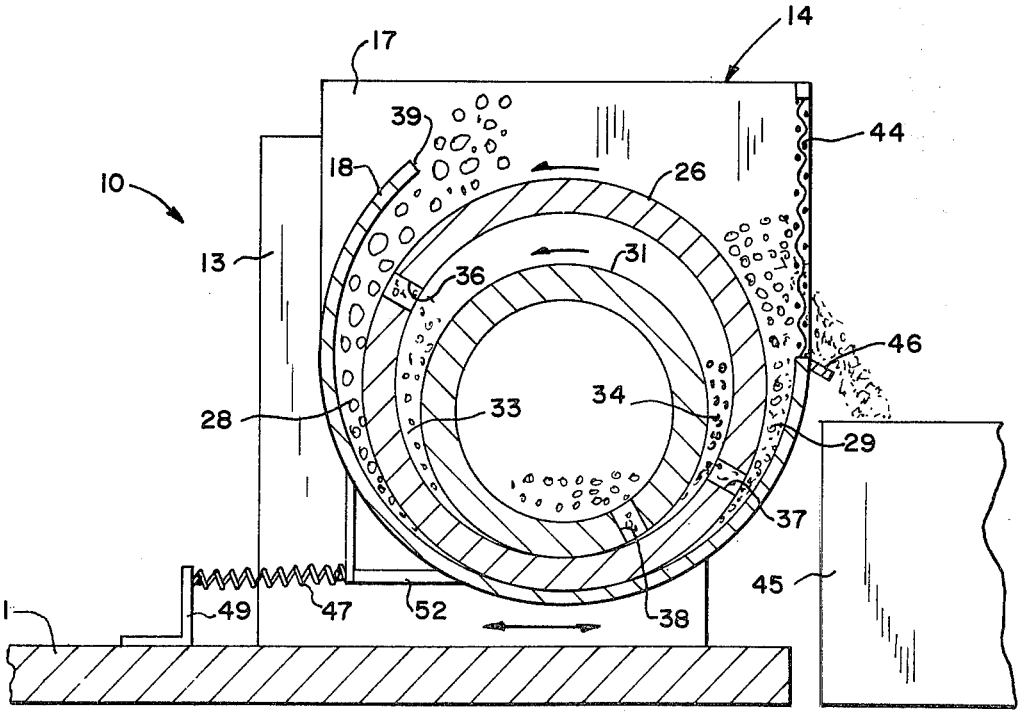
FIG. 4 is a cross-sectional view taken along the line 4—4 of FIG. 3.

The raw quartz ore which has been processed through primary and secondary stage crushing operations is mixed with a liquid such as water in a ratio of one ton of ore to one and one quarter tons of water. Motor 53 is started and operated at 500 r.p.m., and at the same time the mixture of ore and water is deposited through inlet zone 41 and into wedge-space 28. On each forward thrust stroke of rod 56 the cradle is pivoted about support axis 24 through a counter-clockwise angle, as viewed in FIG. 1. By this action the roll members 26, 31 are lifted relative to the support frame. On each return stroke the cradle moves downwardly compressing the springs 47, 48. The roll members then fall and impact upon and crush the material within the wedge-shaped spaces. At the same time the off-center direction of fall of the roll members upon impact causes them to undergo an intermittent counter-clockwise rotation or gyration within the cradle. Material flows through the slots 36, 37 in the outer roll member and into the inner wedge-shaped spaces 33, 34 where it is crushed by the action of inner roll member 31, as shown in FIG. 4, for subsequent discharge out through the same slots. Over size particles of material in the wedge-shaped space 29 on the discharge side of the mill enter one of the slots 36 or 37 which has moved to that side of the cradle and flow into the right-hand inner wedge-shaped space 34. Continued counter-clockwise rotation of the two roll members acts to carry this over size material across the top of inner roll member 31 for deposit in the left-hand inner wedge-shaped space 33 where it is recycled and crushed. In addition, a quantity of material in the right-hand space 34 flows into the interior 32 of the inner roll member when its slot 38 moves to the right-hand side of the cradle. Continued rotation of the inner roll member carries slot 38 to the left-hand side where such material is discharged through the slot and into the left-hand space 33 for recycling and crushing. The crushed and pulverized material which progresses upwardly along the right-hand outer wedge shaped space flows over the weir of edge 42, through screen 44 and into receptacle 45. The screen moves up and down with the side of the cradle so that the screen is self-cleaning. A quantity of over size material which cannot pass through the screen is carried on the outer surface of rotating roll member 26 and deposited with the infeed material into the left-hand outer space 28 for recycling and crushing. Using the foregoing procedures mill 10 is operated at a capacity of approximately 500 pounds of ore input per hour.

Figure 7:
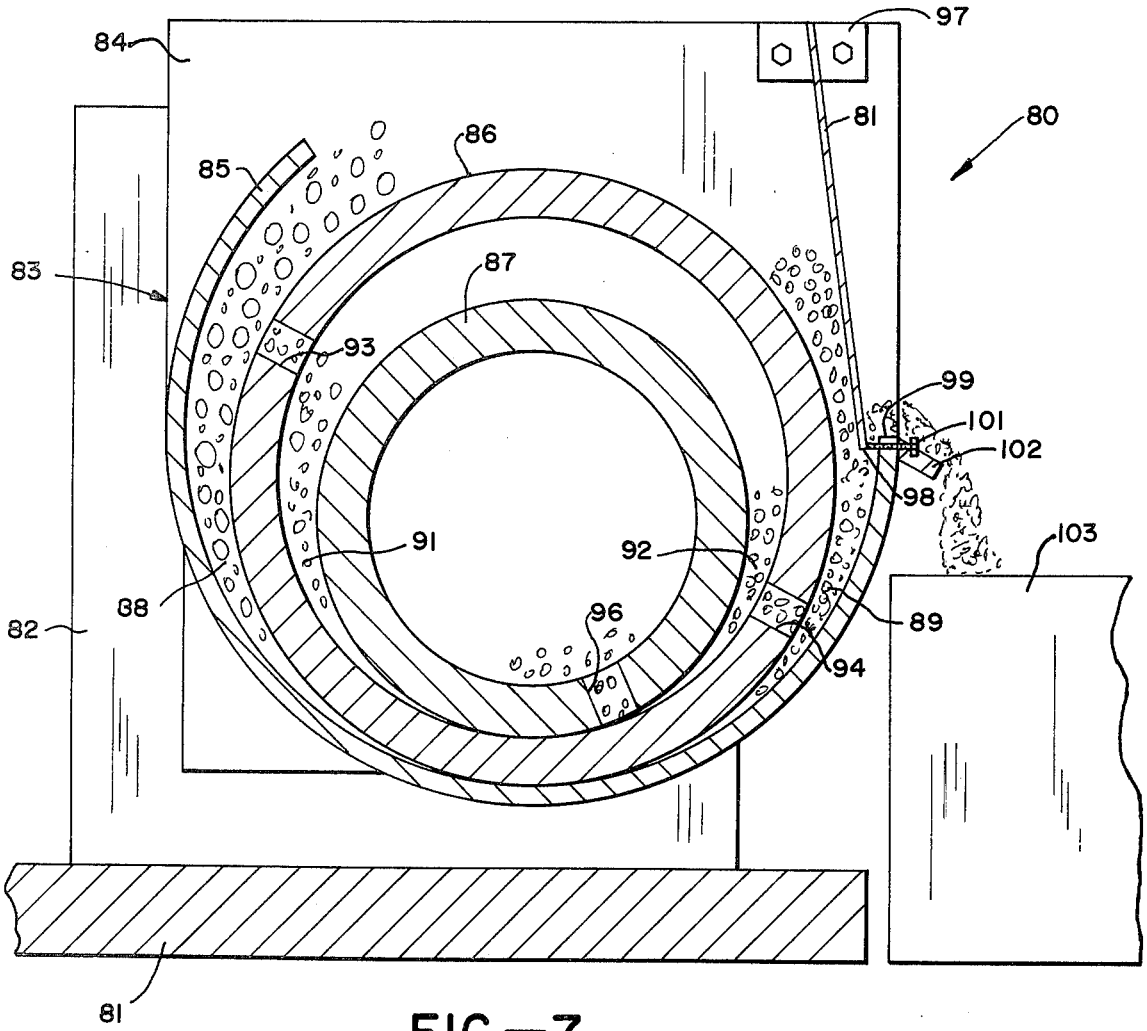
FIG. 7 is a partial cross-sectional view taken through the cradle of another embodiment of the invention.
Figure 5:
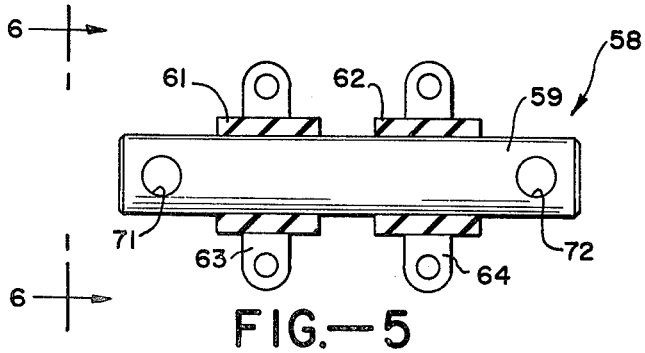
FIG. 5 is a cross-sectional view to an enlarged scale taken along the line 5—5 of FIG. 1.
Figure 6:
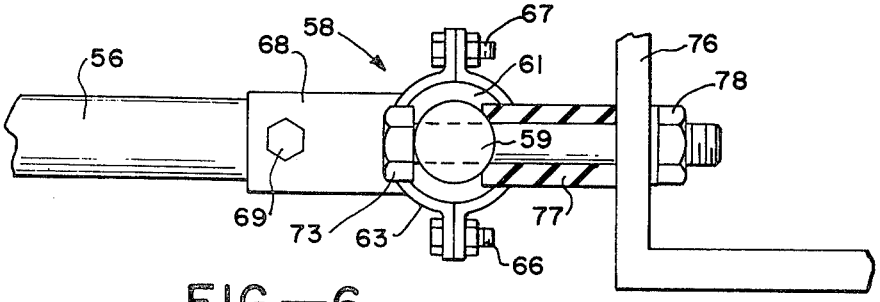
FIG. 6 is a side view taken along the line 6—6 of FIG. 5.

FIG. 7 illustrates another embodiment of the invention providing a mill 80 which incorporates an adjustable baffle plate 81 used in place of the classifying screen of the embodiment of FIGS. 1–6. Mill 80 includes a base 81 carrying a pair of spaced-apart upstanding plates 82 between which a cradle 83 is pivotally mounted on fulcrum pins in a manner similar to that described for the foregoing embodiment. The cradle includes a pair of end plates 84 between which an upwardly concave, arcuate wall 85 is mounted. Within the interior of wall 85 a large diameter, hollow cylindrical roll member 86 is mounted, and a smaller diameter, hollow cylindrical roll member 87 is mounted within the interior of the outer roll member. Thus, a pair of wedge-spaces 88, 89 are formed between wall 85 and roll member 86, and another pair of wedge-shaped spaces 91, 92 are formed between the interior of roll member 86 and roll member 87. The outer roll member is formed with one or more product recycling openings 93, 94, while the inner roll member 97 is formed with one or more recycling openings 96 which function in a manner similar to that previously described.

One or more counterbalancing compression springs, not shown, are provided to urge cradle 83 to a position in which its effective center of gravity is counterbalanced in an offset to the right of a vertical plane passing through the cradle support axis. Actuating means, not shown, such as the drive motor, eccentric, connecting rod and resilient connection assembly previously described, is provided for imparting a recurrent thrust force to the lower portion of the cradle to cause the roll members to move in the previously described gyratory action.

Baffle plate 81 is mounted to the cradle by means of a pair of brackets 97 which are secured to opposite end plates 84 of the cradle. Plate 81 inclines downwardly from the brackets 97 and is mounted with its lower terminal edge 98 positioned slightly below and in close spaced-apart relationship with the overflow edge 99 of wall 85. The spacing or gap between baffle plate edge 98 and overflow edge 99 is selectively adjusted by means of one or more adjusting set screws 191 which are threadably mounted along the margin of wall edge 99.

In the use and operation of mill 80 the mixture of ore and water is fed from above into the wedge-shaped space 88 and the activating means energized to pivot the cradle and gyrate the roll members for crushing the ore. Baffle plate 81 acts as a weir with its lower edge 98 submerged below the surface of the mixture of crushed material and water so that an area of substantially dead water is formed between plate edge 98 and overflow edge 99. The fines, or finely ground material, are washed out of the cradle through this area of dead water from which they spill over discharge chute 102 into receptacle 103. The over size particles of material are precluded from entering the relatively small-sized opening between the edges 98 and 99, and these over size particles are washed upwardly on the left-hand side of plate 81 and return for recycling and crushing through the roll member slots 93 and 94. Splash from the outer roll member 86 will be caught by baffle plate 81 and run down along its inner surface.

In view of the foregoing it is apparent that there has been provided herein a new and improved mill for comminuting ore material. The mill of the invention is capable of operating with relatively less power requirements in comparison to conventional mills of comparable production capacity. During operation there is less over-grinding and less ore sliming as compared to conventional mills. There is a minimum of steel-to-steel contact so that there is relatively less wear of the steel elements and therefore less steel replacement requirements as compared to conventional equipment. In the crushing operation better ore fracture is obtained following natural cleavage, thus releasing entrapped minerals. There is better conditioning of the ore for gravity separation, so that the need for chemical separation is reduced and therefore there is less environmental degradation. The mill is easier to operate because the water-to-ore density is not as critical as compared to conventional equipment. The mill operates with a relatively good scrubbing action which conditions mill tailings for reprocessing. The mill can also be operated without being anchored to a foundation, thereby facilitating easy transport and set up at various crushing sites. The mill can be turned off and restarted at any stage of operation, either empty or full, as compared to conventional tube or ball mills which must be started and stopped with set procedures. In addition, for a mill of given outer diameter the product through-put capacity of the invention can be increased by lengthening the roll elements and cradle.

While the foregoing embodiments are at present considered to be preferred it is understood that numerous variations and modifications may be made therein by those skilled in the art and it is intended to cover in the appended claims all such variations and modifications as fall within the true spirit and scope of the invention.

I claim:

1. A mill for comminuting material such as mineral ores comprising the combination of a support frame, a cradle having an arcuate wall extending about a generally horizontal axis between an inlet zone and a discharge zone, at least one hollow cylindrical shell roll member supported on said arcuate wall within the cradle, the cylindrical roll member extending along a longitudinal axis disposed generally parallel with the axis of said arcuate wall, said roll member having an outer diameter less than the inner diameter of said arcuate wall whereby wedge-shaped spaces are defined therebetween, means mounting the cradle at a position on the frame for pivotal movement about a support axis which is in a vertical plane offset horizontally from the effective center of gravity of the cradle and roll member, and actuating means to move said cradle in a gyratory action through an angle about said support axis with an amplitude which is effective to cause the roll member to be lifted on one stroke and then fall back on alternate strokes within the cradle for comminuting material which is supplied through the inlet zone and into the wedge-shaped spaces.

2. A mill for comminuting material such as mineral ores comprising the combination of a support frame, a cradle having an arcuate wall extending between an inlet zone and a discharge zone, at least one cylindrical roll member supported on said arcuate wall within the cradle, the cylindrical roll member extending along a longitudinal axis disposed lengthwise of said arcuate wall, said roll member having an outer diameter less than the inner diameter of said arcuate wall whereby wedge-shaped spaces are defined therebetween, means mounting the cradle on the frame for pivotal movement about a support axis which is in a vertical plane offset horizontally from the effective center of gravity from the cradle and roll member, said support axis further being disposed in a plane spaced above said effective center of gravity, and actuating means to move said cradle in a gyratory action through an angle about said support axis with an amplitude which is effective to cause the roll member to move within the cradle for comminuting material which is supplied through the inlet zone and into the wedge-shaped spaces, said actuating means imparting recurrent thrust forces in a series of strokes to the cradle acting in a plane disposed below said effective center of gravity, said thrust force moving the cradle on each stroke in one direction to lift the roll member, said cradle thereafter moving on each stroke in an opposite direction whereby the roll member falls downwardly against the material and arcuate wall and is thereby caused to undergo intermittent rotatin about its longitudinal axis within the cradle.

3. A mill as in claim 2 which includes means forming at least one opening in the outer circumference of the roll member to receive material from the wedge-shaped spaces and to carry such material as the roll member rotates for recycling and further comminution of the material.

4. A mill as in claim 2 in which the roll member is formed with a hollow interior, and means forming an opening through the outer circumference of the roll member to direct material into and from the interior.

5. A mill as in claim 2 in which the means forming the opening comprises one or more elongate slots formed in the outer circumference of the roll member and extending longitudinally thereof.

6. A mill for comminuting material such as mineral ores comprising the combination of a support frame, a cradle having an arcuate wall extending between an inlet zone and a discharge zone, at least one cylindrical roll member formed with a hollow interior and supported on said arcuate wall within the cradle, the cylindrical roll extending along a longitudinal axis disposed lengthwise of said arcuate wall, said roll member having an outer diameter less than the inner diameter of said arcuate wall whereby wedge-shaped spaces are defined therebetween, means mounting the cradle on the frame for pivotal movement about a support axis which is in a vertical plane offset horizontally from the effective center of gravity of the cradle and roll member, a second cylindrical roll member supported within said first roll member and extending along an axis parallel with said support axis, said second roll member having an outer diameter less than the inner diameter of said first roll member, means forming at least one opening in the outer circumference of the first roll member to feed material into said interior for comminution therein by relative movement between the roll members as the cradle is moved, and actuating means to move said cradle in a gyratory action through an angle about said support axis with an amplitude which is effective to cause the roll member to move within the cradle for comminuting material which is supplied through the inlet zone and into the wedge-shaped spaces.

7. A mill as in claim 6 in which the second roll member is formed with a hollow interior, together with means forming at least one opening in the outer circumference of the second roll member to feed material into the interior thereof.

8. A mill as in claim 1 which includes material classification means at said discharge zone for only permitting discharge of material sized below a given particle size whereby particles of a large size are retained within the cradle for recycling by the roll member and subsequent comminuting.

9. A mill as in claim 8 in which the classification means comprises a substantially upstanding screen mounted for movement with said cradle at the discharge zone whereby movement of said cradle imparts movement to the screen for a self-cleaning screen action thereof.

10. A mill as in claim 1 in which the support frame includes fulcrum means at said support axis, and the cradle is mounted on and depends downwardly from said fulcrum means, together with resilient means connected between the frame and a lower portion of the cradle for yieldably urging the cradle toward said position at which said support axis is offset horizontally from the center of gravity of the cradle and roll member.

11. A mill as in claim 10 in which the actuating means includes means to impart reciprocating motion to a lower portion of the cradle in a direction along an axis lying in a plane normal to said support axis for intermittently rotating the roll member about its longitudinal axis.

12. A mill as in claim 11 in which the actuating means includes a motor, an eccentric driven by said motor, and a connecting rod interconnecting said eccentric with said lower portion of the cradle.

13. A mill as in claim 12 which includes resilient means for connecting the rod with the lower portion of the cradle for absorbing the shock forces therebetween to permit the cradle and roll members to move in resonance.

14. A mill as in claim 1 which includes baffle plate means mounted on said cradle at the discharge zone, the discharge zone having an overflow edge for discharging material thereover, said baffle plate means including a lower edge positioned in close spaced-apart relationship with said overflow edge for only permitting discharge of material sized below a given particle size whereby particles of a larger size are retained within the cradle for recycling by the roll member and subsequent comminuting.

15. A roll member as in claim 14 in which said lower edge of the baffle plate means is disposed below the elevation of said overflow edge for forming an area of dead water between said edges into which fines are washed up from the cradle for discharge.

16. A mill as in claim 15 which includes means for selectively positioning the spacing between said baffle plate edge and said overflow edge.

17. A mill for comminuting material such as mineral ores, comprising the combination of a support frame, a cradle having a pair of axially spaced apart end walls and an upwardly concave arcuate wall mounted between the end walls, the arcuate wall being disposed with one side edge establishing an inlet zone and an opposite side edge establishing a discharge zone, fulcrum means on the frame for supporting the end walls for pivotal movement of the cradle about a support axis, a first cylindrical roll member carried within and axised lengthwise of the arcuate wall, the outer diameter of said first roll member being less than the inner diameter of said arcuate wall whereby wedge-shaped spaces are defined therebetween, said first roll member being formed with a hollow interior, a second cylindrical roll member carried within said interior and axised lengthwise of the first roll member, the second roll member having an outer diameter less than the inner diameter of said first member whereby wedge-shaped spaces are defined therebetween, means forming at least one opening in the first roll member for feeding the material into and from the interior thereof, counterbalancing compression spring means yieldably urging the cradle to a position at which the effective center of gravity of the cradle and roll members is offset horizontally from a vertical plane passing through said support axis, and actuating means for imparting a recurrent thrust force to a lower portion of the cradle for moving the cradle in a gyratory action through an angle about the support axis to cause the roll members to move and intermittently rotate about their lengthwise axes for comminuting material contained within said wedge-shaped spaces.

18. A mill as in claim 17 in which said second roll member is formed with a hollow interior, together with means forming at least one opening in said second roll member for feeding material into and from the hollow interior of the second roll member.

19. A mill as in claim 18 which includes an upstanding screen extending between said end walls across said discharge zone above said opposite side edge of the arcuate wall, said screen being mounted for movement with the cradle for self-cleaning screening action of the material which is discharged therethrough as the cradle is moved about the support axis.

* * * * *